US009911516B2

(12) United States Patent
Loewen et al.

(10) Patent No.: US 9,911,516 B2
(45) Date of Patent: Mar. 6, 2018

(54) COOLING SYSTEMS FOR SPENT NUCLEAR FUEL, CASKS INCLUDING THE COOLING SYSTEMS, AND METHODS FOR COOLING SPENT NUCLEAR FUEL

(71) Applicants: Eric Paul Loewen, Wilmington, NC (US); Brian Scott Triplett, Wilmington, NC (US); Brett Jameson Dooies, Wilmington, NC (US)

(72) Inventors: Eric Paul Loewen, Wilmington, NC (US); Brian Scott Triplett, Wilmington, NC (US); Brett Jameson Dooies, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 419 days.

(21) Appl. No.: 13/727,014

(22) Filed: Dec. 26, 2012

(65) Prior Publication Data

US 2014/0177775 A1 Jun. 26, 2014

(51) Int. Cl.

| | |
|---|---|
| ***G21F 5/10*** | (2006.01) |
| ***G21H 1/10*** | (2006.01) |
| ***G21F 5/008*** | (2006.01) |

(52) U.S. Cl.

CPC ..... *G21F 5/10* (2013.01); *G21F 5/008* (2013.01); *G21H 1/103* (2013.01)

(58) Field of Classification Search

CPC ... G21D 7/04; G21F 5/10; G21H 1/10; G21H 1/103; G21H 5/00; G21H 3/00; G21H 1/106

(Continued)

(56) References Cited

U.S. PATENT DOCUMENTS 3,737,620 A * 6/1973 Harvey ..... B63C 11/28 126/204
3,911,684 A * 10/1975 Busey ..... F03G 7/00 122/32

(Continued)

FOREIGN PATENT DOCUMENTS

JP 07120591 A 5/1995
WO 2013019589 A2 2/2013

OTHER PUBLICATIONS

Bullard, T. "Thermal analysis of proposed transport cask for three advanced burner reactor used fuel assemblies" Packaging, Transport, Storage & Security of Radioactive Material. 2010. vol. 21. No. 3. pp. 158-164.

(Continued)

*Primary Examiner* — Sharon M Davis
(74) *Attorney, Agent, or Firm* — Harness, Dickey & Pierce, P.L.C.

(57) ABSTRACT

A cooling system for spent nuclear fuel may include a device configured to generate electricity using energy emitted from the spent nuclear fuel. The cooling system may be configured to use the electricity when cooling the spent nuclear fuel. A cask for storage, transport, or storage and transport of spent nuclear fuel may include the cooling system and a container configured to hold the spent nuclear fuel. A method for cooling spent nuclear fuel may include generating electricity using energy emitted from the spent nuclear fuel, and using the electricity in a cooling system for the spent nuclear fuel when cooling the spent nuclear fuel.

22 Claims, 5 Drawing Sheets

(58) Field of Classification Search
USPC ..... 588/16; 220/592.28
See application file for complete search history.

(56) References Cited

U.S. PATENT DOCUMENTS

| | | | | |
|---|---|---|---|---|
| 4,288,997 | A * | 9/1981 | Friesen | G21F 5/10 165/60 |
| 4,299,659 | A * | 11/1981 | Hame | G21F 9/34 250/506.1 |
| 4,472,347 | A * | 9/1984 | Quillmann | G21F 9/36 136/202 |
| 4,830,817 | A * | 5/1989 | Schulten | 376/320 |
| 6,797,972 | B2 | 9/2004 | Kamoshida et al. | |
| 7,068,748 | B2 | 6/2006 | Singh | |
| 7,330,526 | B2 | 2/2008 | Singh | |
| 7,811,475 | B2 | 10/2010 | Hayashi | |
| 7,933,374 | B2 | 4/2011 | Singh | |
| 7,973,298 | B2 | 7/2011 | Shimojo et al. | |
| 7,994,380 | B2 | 8/2011 | Singh et al. | |
| 8,009,789 | B2 | 8/2011 | Baudouin et al. | |
| 8,039,824 | B2 | 10/2011 | Grinder et al. | |
| 8,098,790 | B2 | 1/2012 | Singh | |
| 8,135,107 | B2 | 3/2012 | Singh et al. | |
| 2006/0215803 | A1 | 9/2006 | Singh | |
| 2008/0095295 | A1* | 4/2008 | Fuls | 376/272 |
| 2010/0303191 | A1 | 12/2010 | Yeh et al. | |
| 2011/0283701 | A1 | 11/2011 | Eftekharzadeh | |
| 2013/0028365 | A1* | 1/2013 | Tatli | G21C 19/08 376/272 |

OTHER PUBLICATIONS

International Search Report and Written Opinion issued in connection with corresponding PCT Application No. PCT/US2013/073803 dated Aug. 4, 2014.

* cited by examiner

COOLING SYSTEMS FOR SPENT NUCLEAR FUEL, CASKS INCLUDING THE COOLING SYSTEMS, AND METHODS FOR COOLING SPENT NUCLEAR FUEL

BACKGROUND

1. Field

Example embodiments generally relate to cooling systems for spent nuclear fuel (also known as "used nuclear fuel"). Example embodiments also generally relate to casks including cooling systems for spent nuclear fuel ("SNF"). Additionally, example embodiments generally relate to methods for cooling SNF.

2. Description of Related Art

Nuclear fuel discharged from the reactor of a nuclear plant is known as SNF. SNF is intensely radioactive. The associated radioactive decay creates heat, requiring some mechanism for cooling the SNF. Typically, SNF is initially stored in pools of water or other coolant (known as "wet storage"). The water or other coolant may provide both radiation shielding and cooling.

As SNF ages, the radioactivity level may drop, as may the associated heat generation. At some point, the heat generation may drop to a point at which wet storage is no longer required. After meeting the minimum wet storage period, the SNF may be removed from the pool and placed in appropriate dry transportation and/or storage systems (known as "dry storage").

SNF from light water reactors is typically cooled at least 5 years in wet storage. Although the Nuclear Regulatory Commission ("NRC") has authorized transfer to dry storage as early as 3 years, the industry norm is about 10 years.

In contrast, SNF from liquid-metal-cooled reactors may be, for example, stored within the reactor vessel pool for a fuel cycle (e.g., 18-24 months) before transfer to dry storage.

In the U.S., two basic types of dry transportation and/or storage systems are used, bare-fuel casks and canister-based systems.

In bare-fuel casks, assemblies of SNF typically are placed into a basket that is integrated into a cask and the cask is then sealed. In canister-based systems, assemblies of SNF typically are placed into baskets integrated into a thin-walled cylinder, referred to as a canister, and the canister is then sealed. For both types of casks, transportation and long-term storage typically require the use of an overpack to protect the cask or canister against external man-made events and external natural phenomena.

The stages of the nuclear fuel cycle may be considered to include processing, enrichment, fabrication of the nuclear fuel, use of the nuclear fuel, storage of the SNF, and reprocessing of the SNF for the enrichment stage. Due to well-publicized problems associated with the reprocessing stage, the storage stage for SNF has become much more important. And due to well-publicized problems associated with the storage stage, particularly concerns about wet storage, the ability to move SNF from wet storage to dry storage as quickly as possible and to store the SNF in dry storage for as long as possible have become the focus of considerable research. Both the ability to move SNF from wet storage to dry storage and to store the SNF in dry storage depend on the ability of the associated dry transportation and/or storage system to dissipate the heat created by the radioactive decay of the SNF.

SUMMARY

Example embodiments may provide cooling systems for SNF. Example embodiments also may provide casks including cooling systems for SNF. Additionally, example embodiments may provide methods for cooling SNF.

In some example embodiments, a cooling system for spent nuclear fuel may comprise a device configured to generate electricity using energy emitted from the spent nuclear fuel. The cooling system may be configured to use the electricity when cooling the spent nuclear fuel.

In some example embodiments, the device may be configured to generate electricity using heat emitted from the spent nuclear fuel.

In some example embodiments, the device may be configured to generate electricity based on a thermoelectric effect.

In some example embodiments, the device may be configured to generate electricity based on a Seebeck effect.

In some example embodiments, the device may comprise a radioisotope thermoelectric generator.

In some example embodiments, the cooling system may comprise one or more of a compressor, a fan, a pump, and a heat exchanger.

In some example embodiments, the cooling system may comprise one or more compressors, fans, pumps, and/or heat exchangers.

In some example embodiments, the cooling system may comprise coolant.

In some example embodiments, the coolant may comprise one or more of helium (He), neon (Ne), argon (Ar), krypton (Kr), xenon (Xe), radon (Rn), and nitrogen (N).

In some example embodiments, the coolant may comprise one or more of helium (He) gas, neon (Ne) gas, argon (Ar) gas, krypton (Kr) gas, xenon (Xe) gas, radon (Rn) gas, and nitrogen ($N_2$) gas.

In some example embodiments, the coolant may comprise air.

In some example embodiments, the coolant may comprise water.

In some example embodiments, the coolant may comprise liquid sodium.

In some example embodiments, a cask for storage, transport, or storage and transport of spent nuclear fuel may comprise the cooling system and/or a container configured to hold the spent nuclear fuel.

In some example embodiments, the cooling system may be internal to the container.

In some example embodiments, one or more portions of the cooling system may be internal to the container.

In some example embodiments, one or more portions of the cooling system may be external to the container.

In some example embodiments, the cooling system may comprise coolant.

In some example embodiments, the coolant may comprise one or more of helium (He), neon (Ne), argon (Ar), krypton (Kr), xenon (Xe), radon (Rn), and nitrogen (N).

In some example embodiments, the coolant may comprise one or more of helium (He) gas, neon (Ne) gas, argon (Ar) gas, krypton (Kr) gas, xenon (Xe) gas, radon (Rn) gas, and nitrogen ($N_2$) gas.

In some example embodiments, the coolant may comprise air.

In some example embodiments, the coolant may comprise water.

In some example embodiments, the coolant may comprise liquid sodium.

In some example embodiments, the cask may further comprise a flowpath for the coolant within the container. The cooling system may be configured to cause the coolant to follow the flowpath when cooling the spent nuclear fuel.

In some example embodiments, a method for cooling spent nuclear fuel may comprise generating electricity using energy emitted from the spent nuclear fuel and/or using the electricity in a cooling system for the spent nuclear fuel when cooling the spent nuclear fuel.

In some example embodiments, the generating may comprise generating electricity using heat emitted from the spent nuclear fuel.

In some example embodiments, the generating may comprise generating electricity based on a thermoelectric effect.

In some example embodiments, the generating may comprise generating electricity based on a Seebeck effect.

In some example embodiments, the generating may comprise generating electricity using a radioisotope thermoelectric generator These and other features and advantages of this invention are described in, or are apparent from, the following detailed description of various example embodiments of the apparatuses and methods according to the invention.

BRIEF DESCRIPTION OF THE DRAWINGS

The above and/or other aspects and advantages will become more apparent and more readily appreciated from the following detailed description of example embodiments, taken in conjunction with the accompanying drawings, in which.

DETAILED DESCRIPTION OF EXAMPLE EMBODIMENTS

Figure 1:
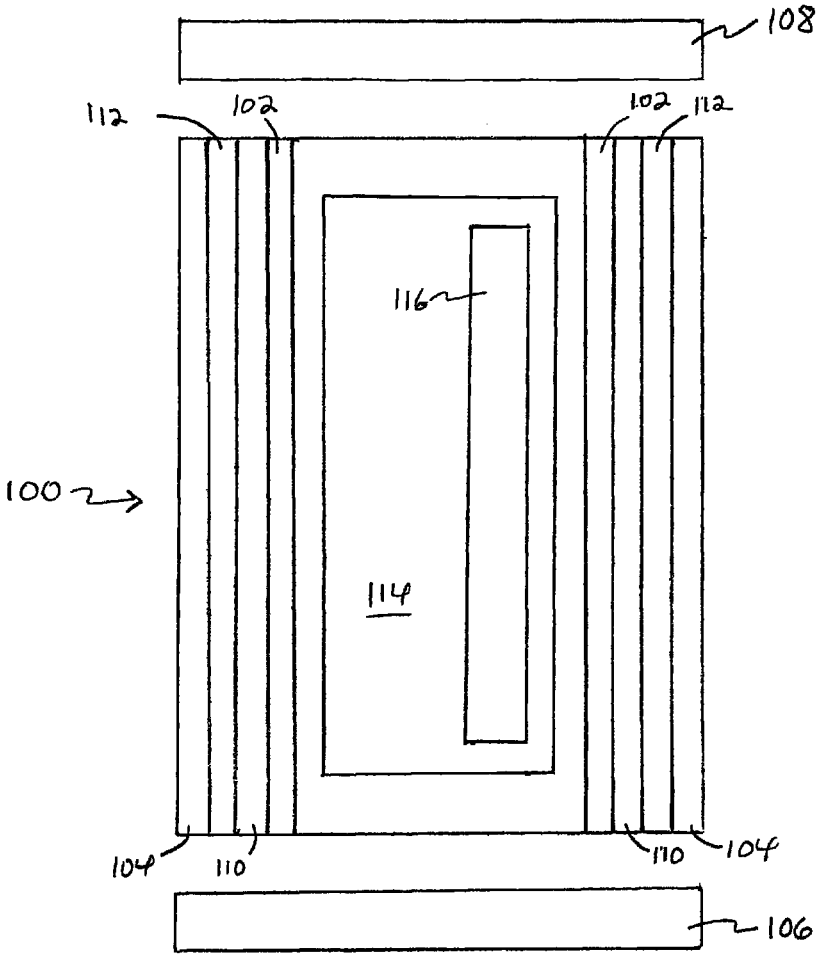
FIG. 1 (RELATED ART)
FIG. 1 is a cut-away view of a related art cask for SNF.

Example embodiments will now be described more fully with reference to the accompanying drawings. Embodiments, however, may be embodied in many different forms and should not be construed as being limited to the embodiments set forth herein. Rather, these example embodiments are provided so that this disclosure will be thorough and complete, and will fully convey the scope to those skilled in the art. In the drawings, the thicknesses of layers and regions are exaggerated for clarity.

It will be understood that when an element is referred to as being "on," "connected to," "electrically connected to," or "coupled to" to another component, it may be directly on, connected to, electrically connected to, or coupled to the other component or intervening components may be present. In contrast, when a component is referred to as being "directly on," "directly connected to," "directly electrically connected to," or "directly coupled to" another component, there are no intervening components present. As used herein, the term "and/or" includes any and all combinations of one or more of the associated listed items.

It will be understood that although the terms first, second, third, etc., may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. For example, a first element, component, region, layer, and/or section could be termed a second element, component, region, layer, and/or section without departing from the teachings of example embodiments.

Spatially relative terms, such as "beneath," "below," "lower," "above," "upper," and the like may be used herein for ease of description to describe the relationship of one component and/or feature to another component and/or feature, or other component(s) and/or feature(s), as illustrated in the drawings. It will be understood that the spatially relative terms are intended to encompass different orientations of the device in use or operation in addition to the orientation depicted in the figures.

The terminology used herein is for the purpose of describing particular example embodiments only and is not intended to be limiting of example embodiments. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

It should also be noted that in some alternative implementations, functions, and/or acts noted may occur out of the order noted in the figures. For example, two figures shown in succession may in fact be executed substantially concurrently or may sometimes be executed in the reverse order, depending upon the functionality and/or acts involved.

Reference will now be made to example embodiments, which are illustrated in the accompanying drawings, wherein like reference numerals may refer to like components throughout.

FIG. 1 is a cut-away view of related art cask 100 for SNF. Cask 100 may be designed for storage, transport, or storage and transport of SNF.

As shown in FIG. 1, cask 100 may include inner shell 102 and/or outer shell 104. Depending on its design and/or intended use, cask 100 may include bottom closure 106 and/or lid 108. Typically, inner shell 102 and/or outer shell 104 are welded to bottom closure 106. Typically, inner shell 102 and/or outer shell 104 are bolted (with o-ring or similar seals) or welded to lid 108.

As known to a person having ordinary skill in the art ("PHOSITA"), inner shell 102 may comprise steel, such as stainless steel, or other suitable materials. As also known to a PHOSITA, outer shell 104 may comprise steel, such as stainless steel, or other suitable materials. Inner shell 102 and/or outer shell 104 may provide radiation shielding from SNF stored in cask 100. Inner shell 102 and/or outer shell 104 may provide shielding from alpha radiation, beta radiation, electromagnetic radiation (γ-rays, X-rays), and/or neutron radiation.

As shown in FIG. 1, cask 100 also may include one or more types of radiation shielding between inner shell 102 and outer shell 104. The one or more types of shielding may include gamma radiation shielding 110 (e.g., primarily designed to shield γ-rays) and/or neutron radiation shielding 112 (e.g., primarily designed to shield neutron radiation). Because gamma radiation shielding 110 may provide thermal and/or other protection to neutron radiation shielding 112, gamma radiation shielding 110 may be closer to inner shell 102 than neutron radiation shielding 112. Also, because gamma radiation shielding 110 may provide thermal and/or other protection to neutron radiation shielding 112, neutron radiation shielding 112 may be closer to outer shell 104 than gamma radiation shielding 110. Alternative arrangements of inner shell 102, outer shell 104, gamma radiation shielding 110, and neutron radiation shielding 112 are known to a PHOSITA.

Gamma radiation shielding 110 may include, for example, materials with high density, such as iron, lead (with or without copper), various types of steel, tungsten, and depleted uranium. Bottom closure 106 and/or lid 108 also may provide shielding from gamma radiation, for example, by incorporating one or more materials that provide shielding from gamma radiation.

Neutron radiation shielding 112 may include, for example, materials with high concentrations of hydrogen atoms, such as epoxy resins, hafnium hydride, paraffins, polymers, water-ethylene glycol mixtures, water-extended polyesters, zirconium hydride, and/or NS-4-FR (a solid, borated, hydrogenous synthetic polymer). In addition or in the alternative, neutron radiation shielding 112 may include boron, such as borated polyester resin compounds, borated polypropylenes, borated water, boron carbides (e.g., $B_4C$; BORAL®, a composite of aluminum and boron carbide), and/or boron nitrides. In addition or in the alternative, neutron radiation shielding 112 may include, for example, cadmium oxide, gadolinium oxide, and/or samarium oxide. Neutron radiation shielding 112 may include fire retardant materials such as, for example, aluminum hydroxide, calcium hydroxide, magnesium hydroxide, and/or hydrogarnet. Bottom closure 106 and/or lid 108 also may provide shielding from neutron radiation, for example, by incorporating one or more materials that provide shielding from neutron radiation.

As shown in FIG. 1, cask 100 also may include optional basket assembly 114 for supporting, for example, one or more fuel assemblies 116 of the SNF, along with one or more other radioactive components 118 (e.g., components of blanket, control, instrumentation, reflector, and/or shield). When supporting fuel assemblies 116 and one or more other radioactive components 118, basket assembly 114 is normally inside inner shell 102. In the alternative, cask 100 may support fuel assemblies 116 and one or more other radioactive components 118 without basket assembly 114.

As known to a PHOSITA, cask 100 may include one or more connections between the environment internal to cask 100 and the environment external to cask 100. Such connections may include, for example, one or more drains (not shown) and/or vents (not shown). Typically, the one or more drains and/or vents are in lid 108. Cask 100 also may include a pressure monitoring system (not shown), a temperature monitoring system (not shown), and/or other instrumentation.

As known to a PHOSITA, cask 100 may include upper and/or lower trunnions or similar fixtures (not shown) to provide for lifting, rotating, etc., cask 100.

Figure 2:
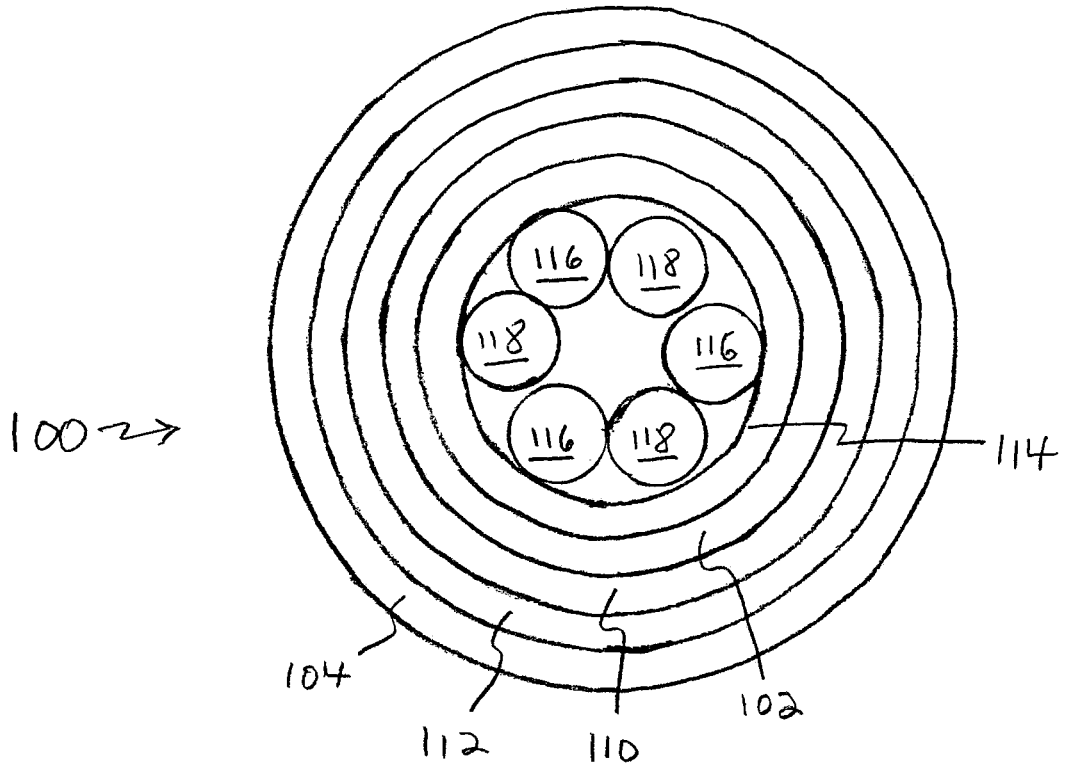
FIG. 2 (RELATED ART)
FIG. 2 is a top view of the related art cask of FIG. 1.

FIG. 2 is a top view of related art cask 100 of FIG. 1. As shown in FIGS. 1 and 2, cask 100 may be cylindrical in shape. However, cask 100 may assume other shapes, as well.

As shown in FIG. 2, cask 100 may include inner shell 102, outer shell 104, gamma radiation shielding 110, and/or neutron radiation shielding 112. Alternative arrangements of inner shell 102, outer shell 104, gamma radiation shielding 110, and neutron radiation shielding 112 are known to a PHOSITA.

As shown in FIG. 2, cask 100 may include optional basket assembly 114 for supporting, for example, one or more fuel assemblies 116 and one or more other radioactive components 118. As shown in FIGS. 1 and 2, basket assembly 114 may be cylindrical in shape. However, in some example embodiments, basket assembly 114 may assume other shapes, as well.

Basket assembly 114 may include dividers or similar structures (not shown) to assist in the organization and control of fuel assemblies 116 and one or more other radioactive components 118 to help satisfy nuclear criticality prevention requirements. In addition or in the alternative, basket assembly 114 may provide neutron absorption to help satisfy nuclear criticality prevention requirements. Basket assembly 114 may transfer heat directly and/or indirectly to inner shell 102.

Thermal and/or SNF loading/density considerations may limit the number of fuel assemblies 116 and/or other radioactive components 118 that optional basket assembly 114 may support. As shown in FIG. 2, for example, optional basket assembly 114 may support only three fuel assemblies 116, along with one or more other radioactive components 118. In the alternative, optional basket assembly 114 shown in FIG. 2 may support more than three fuel assemblies 116 after potentially extended and expensive delays. As known to a PHOSITA, numerous other arrangements are possible for optional basket assembly 114. However, as also known to a PHOSITA, thermal and/or SNF loading/density considerations should be considered no matter what the arrangement.

As shown in FIGS. 1 and 2, fuel assemblies 116 and/or other radioactive components 118 may be cylindrical in shape. However, in some example embodiments, fuel assemblies 116 and/or other radioactive components 118 may assume other shapes, as well. In a top view, for example, the cross-section of fuel assemblies 116 may be rectangular or square. In top view, for example, other radioactive components 118 may assume shapes consistent with their design(s).

As known to a PHOSITA, the environment internal to cask 100 typically is controlled when fuel assemblies 116 and/or one or more other radioactive components 118 are in cask 100 (e.g., within inner shell 102). For example, the volume within inner shell 102, not occupied by basket assembly 114, fuel assemblies 116, and/or one or more other radioactive components 118 may be drained of coolant (e.g., water), vacuum dried, and backfilled with an inert gas (typically helium).

As known to a PHOSITA, fuel assemblies 116 generate significant heat due to radioactive decay of the SNF. Engineering and safety considerations require that heat to be dissipated. The heat dissipation may be passive in nature, with heat generally flowing from fuel assemblies 116 outward toward outer shell 104, bottom closure 106, and/or lid 108. For example, the heat dissipation may be via one or more of heat conduction through solid materials, natural convection of the inert gas, and thermal radiation.

Heat transfer via heat conduction may be improved, for example, by providing multiple heat flow paths from fuel assemblies 116, through basket assembly 114, to inner shell 102 and/or by providing radial heat fins (not shown) between inner shell 102 and outer shell 104. Although heat transfer via natural convection of the inert gas is somewhat disorganized (e.g., occurring throughout the volume within inner shell 102 backfilled with the inert gas), it may be improved, for example, by selection of an inert gas with good heat transfer characteristics (e.g., helium). Heat transfer via thermal radiation may be improved, for example, by increasing the temperature difference between outer shell 104, bottom closure 106, and/or lid 108 and the environment external to cask 100.

Figure 3:
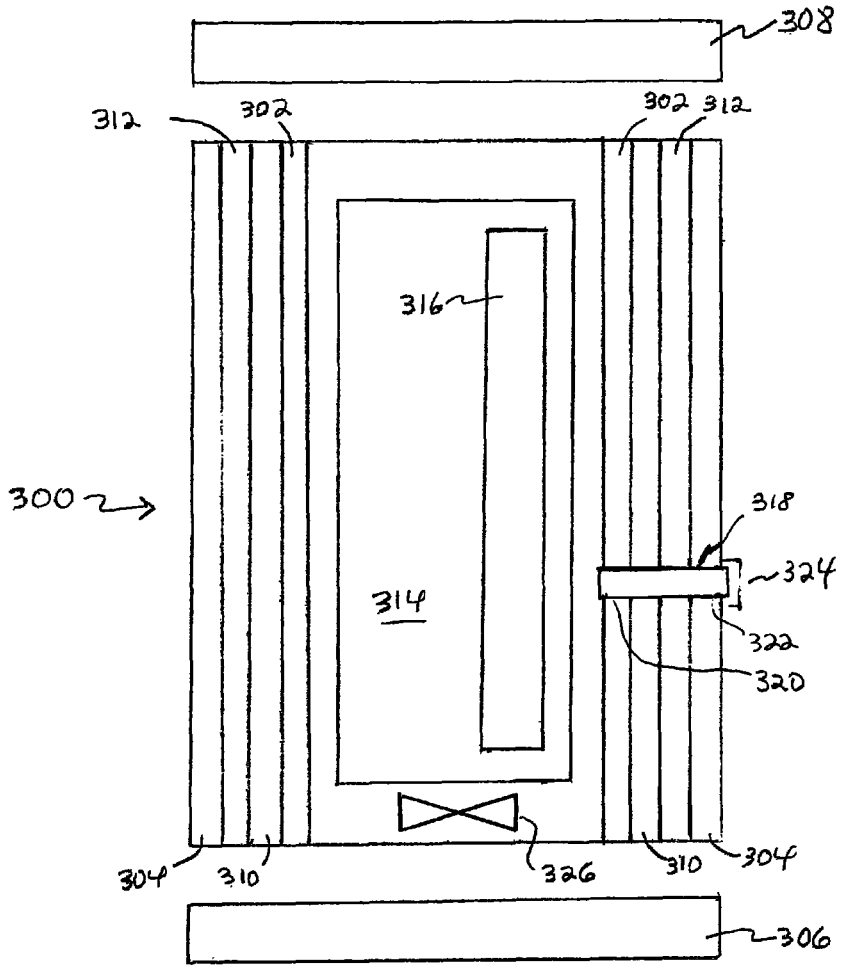
FIG. 3 is a cut-away view of a cask for SNF according to some example embodiments.

FIG. 3 is a cut-away view of a cask 300 for SNF according to some example embodiments. Cask 300 may be designed for storage, transport, or storage and transport of SNF.

As shown in FIG. 3, cask 300 may include inner shell 302 and/or outer shell 304. Depending on its design and/or intended use, cask 300 may include bottom closure 306 and/or lid 308. Inner shell 302 and/or outer shell 304 may be welded to bottom closure 306. In the alternative, bottom closure 306 may be fixed to inner shell 302 and/or outer shell 304 by bolts or similar devices. Inner shell 302 and/or outer shell 304 may be welded to lid 308. In the alternative, lid 308 may be fixed to inner shell 302 and/or outer shell 304 by bolts or similar devices.

In some example embodiments, inner shell 302 may comprise steel, such as stainless steel, or other suitable materials. Outer shell 304 may comprise steel, such as stainless steel, or other suitable materials. Inner shell 302 and/or outer shell 304 may provide radiation shielding from SNF stored in cask 300. Inner shell 302 and/or outer shell 304 may provide shielding from alpha radiation, beta radiation, electromagnetic radiation (γ-rays, X-rays), and/or neutron radiation.

As shown in FIG. 3, cask 300 also may include one or more types of radiation shielding between inner shell 302 and outer shell 304. The one or more types of shielding may include gamma radiation shielding 310 (e.g., primarily designed to shield γ-rays) and/or neutron radiation shielding 312 (e.g., primarily designed to shield neutron radiation). Because gamma radiation shielding 310 may provide thermal and/or other protection to neutron radiation shielding 312, gamma radiation shielding 310 may be closer to inner shell 302 than neutron radiation shielding 312. Also, because gamma radiation shielding 310 may provide thermal and/or other protection to neutron radiation shielding 312, neutron radiation shielding 312 may be closer to outer shell 304 than gamma radiation shielding 310. Some example embodiments include alternative arrangements of inner shell 302, outer shell 304, gamma radiation shielding 310, and neutron radiation shielding 312, such as multiple layers of gamma radiation shielding 310 and/or neutron radiation shielding 312. Such multiple layers of gamma radiation shielding 310 and neutron radiation shielding 312 may, for example, alternate in a radial direction.

In some example embodiments, gamma radiation shielding 310 may include, for example, materials with high density, such as iron, lead (with or without copper), various types of steel, tungsten, and depleted uranium. Bottom closure 306 and/or lid 308 also may provide shielding from gamma radiation, for example, by incorporating one or more materials that provide shielding from gamma radiation.

In some example embodiments, neutron radiation shielding 312 may include, for example, materials with high concentrations of hydrogen atoms, such as epoxy resins, hafnium hydride, paraffins, polymers, water-ethylene glycol mixtures, water-extended polyesters, zirconium hydride, and/or NS-4-FR (a solid, borated, hydrogenous synthetic polymer). In addition or in the alternative, neutron radiation shielding 312 may include boron, such as borated polyester resin compounds, borated polypropylenes, borated water, boron carbides (e.g., $B_4C$; BORAL®, a composite of aluminum and boron carbide), and/or boron nitrides. In addition or in the alternative, neutron radiation shielding 312 may include, for example, cadmium oxide, gadolinium oxide, and/or samarium oxide. Neutron radiation shielding 312 may include fire retardant materials such as, for example, aluminum hydroxide, calcium hydroxide, magnesium hydroxide, and/or hydrogarnet. Bottom closure 306 and/or lid 308 also may provide shielding from neutron radiation, for example, by incorporating one or more materials that provide shielding from neutron radiation.

As shown in FIG. 3, cask 300 also may include optional basket assembly 314 for supporting, for example, one or more fuel assemblies 316 of the SNF, along with one or more other radioactive components (e.g., components of blanket, control, instrumentation, reflector, or shield). When supporting fuel assemblies 116 (and/or one or more other radioactive components), basket assembly 314 is normally inside inner shell 302. In the alternative, cask 300 may support fuel assemblies 316 (and/or one or more other radioactive components) without basket assembly 314.

In some example embodiments, cask 300 may include one or more connections between the environment internal to cask 300 and the environment external to cask 300. Such connections may include, for example, one or more drains (not shown) and/or vents (not shown). The one or more drains and/or vents may be in bottom closure 306 and/or lid 308. Cask 300 also may include a pressure monitoring system (not shown), a temperature monitoring system (not shown), and/or other instrumentation.

In some example embodiments, cask 300 may include upper and/or lower trunnions or similar fixtures (not shown) to provide for lifting, rotating, etc., cask 300.

As shown in FIG. 3, cask 300 additionally may include one or more devices 318 configured to generate electricity using energy emitted from the SNF. Devices 318 may be configured to generate electricity using heat emitted from the SNF. Devices 318 may be configured to generate electricity based on a thermoelectric effect. Devices 318 may be configured to generate electricity based on the Seebeck effect. Devices 318 may be part of a radioisotope thermoelectric generator ("RTG"). Devices 318 may be designed to be removable, replaceable, and/or reusable.

The term "thermoelectric effect" may refer to the direct conversion of temperature difference to electrical voltage and vice-versa. The direction of heating and/or cooling may depend on the polarity of the applied voltage. Conversely, the polarity of the applied voltage may determine the direction of heating and/or cooling. Thermoelectric effects may include the Seebeck effect, Peltier effect, and Thomson effect. Each of these effects, briefly discussed below, may be reversible.

The Seebeck effect, discovered in 1821, may be described as demonstrating that a temperature difference across a parallel pair of dissimilar metals generates voltage. The Peltier effect, discovered in 1834, may be described as demonstrating that an electrical current flowing from a point of one dissimilar metal to a point of another dissimilar metal creates a cooling or heating effect at a junction of the dissimilar metals, depending on the direction of current flow. The Thomson effect, first studied in 1850s, may be described as quantifying the heating or cooling of a current-carrying conductor with a temperature gradient along the conductor.

An RTG is a generator configured to generate electrical power from radioactive decay. An RTG may convert heat released from decay of radioactive material to electricity by the Seebeck effect using, for example, an array of thermocouples or thermionic devices.

As shown in FIG. 3, inner end 320 of device 318 may be near, at, or in the volume within inner shell 302 (e.g., near or penetrating an inner wall of inner shell 302). As also shown in FIG. 3, outer end 322 of device 318 may be near, at, or outside of cask 300 (e.g., near or penetrating an outer wall of outer shell 304).

Device 318 may comprise, for example, a thermocouple, thermionic device, one or more thermocouples connected to each other in series to form a closed loop (e.g., a thermopile), or one or more thermionic devices connected to each other in series to form a closed loop.

Devices 318 may be distributed, for example, axially and/or circumferentially around cask 300. Inner end 320 of devices 318 may be vertically distributed, for example, near, at, or in a gas channel defined between inner shell 302 and fuel assemblies 316 (and/or one or more other radioactive components). Inner end 320 of devices 318 may be circumferentially distributed near, at, or in a gas channel defined between inner shell 302 and fuel assemblies 316 (and/or one or more other radioactive components). Inner end 320 of devices 318 may be vertically and circumferentially distributed near, at, or in a gas channel defined between inner shell 302 and fuel assemblies 316 (or one or more other radioactive components), for example, to maximize power generation by devices 318.

As shown in FIG. 3, cask 300 may further include device 324 functioning as a cold junction or heat sink. Device 324 may comprise a junction box. Device 324 may be proximate to outer end 322 of device 318. Devices 324 may be designed to be removable, replaceable, and/or reusable.

As shown in FIG. 3, cask 300 may further include device 326 configured to use the electricity to cool the SNF. Device 326 may be powered by the electricity generated by device 318. Device 326 may comprise one or more of a compressor, a fan, a pump, and a heat exchanger.

Electricity generated by device 318 may be provide to device 326 using, for example, wiring. The wiring (not shown) may be routed from device 318 to device 326 via, for example, bottom closure 306 and/or lid 308. To protect the wiring from contact damage, the wiring may be routed between the inner wall of inner shell 302 and the outer wall of outer shell 304, within bottom closure 306, and/or within lid 308. In addition, the wiring may be routed so as to provide protection from radiation and/or thermal degradation.

A cooling system for cask 300 may include device 318, device 326, and a coolant. The cooling system for cask 300 also may include device 324. Device 318 may provide power to device 326, enabling device 326 to force circulation of the coolant within cask 300. The forced circulation in cask 300 may provide improved heat transfer over the natural convection of the inert gas in cask 100. The improved heat transfer may allow selection of a coolant other than helium (He), such as nitrogen (N), which is less expensive than helium (He).

The coolant in cask 300 may comprise one or more of helium (He), neon (Ne), argon (Ar), krypton (Kr), xenon (Xe), radon (Rn), and nitrogen (N). The coolant in cask 300 may comprise one or more gases or inert gases, such as helium (He) gas, neon (Ne) gas, argon (Ar) gas, krypton (Kr) gas, xenon (Xe) gas, radon (Rn) gas, and nitrogen ($N_2$) gas.

The coolant may comprise air.

The coolant may comprise water. The coolant may comprise water and one or more gases. The coolant comprising water and one or more gases may use evaporative cooling, either alone or in combination with the thermoelectric effect(s).

The coolant may comprise a liquid metal or metals (e.g., lead, lead-bismuth, mercury, sodium, or sodium-potassium). As known to a PHOSITA, some of these metals present challenging issues, such as spontaneous ignition on contact with air and violent reaction with water.

All of the cooling system may be within a volume defined by the outer wall of outer shell 304. One or more portions of the cooling system may be within a volume defined by the outer wall of outer shell 304. One or more portions of the cooling system may not be within a volume defined by the outer wall of outer shell 304 (e.g., one or more portions of the cooling system may be outside the outer wall of outer shell 304).

Higher energy emission from the SNF may cause devices 318 to generate more electricity than lower energy emission from the SNF. Devices 318 generating more electricity may cause devices 326 and/or the cooling system for cask 300 to provide more cooling for the SNF. Lower energy emission from the SNF may cause devices 318 to generate less electricity than higher energy emission from the SNF. Devices 318 generating less electricity may cause devices 326 and/or the cooling system for cask 300 to provide less cooling for the SNF. Effectively, this feedback mechanism may automatically compensate for changes in energy emission by the SNF (i.e., the feedback mechanism may be at least partially self-regulating).

The forced circulation in cask 300 may define a flowpath (s) for coolant within cask 300. The cooling system may be configured to cause the coolant to follow the flowpath(s) when cooling the SNF. In some example embodiments, the flowpath(s) may start at device 326, flow up the middle of cask 300 toward lid 308, flow radially outward along lid 308 toward inner wall 302, flow downward along inner wall 302 toward bottom closure 306, and then flow radially inward along bottom closure 306 toward device 326. In some example embodiments, the flowpath(s) may start at device 326, flow radially outward along bottom closure 306 toward inner wall 302, flow upward along inner wall 302 toward lid 308, flow radially inward along lid 308 toward the middle of cask 300, and then flow down the middle of cask 300 toward device 326.

Cask 300 may include a single device 326. Device 326 may be, for example, associated with bottom closure 306 (e.g., device 326 may be mounted on bottom closure 306). Device 326 may be, for example, associated with a central portion of bottom closure 306. Installation of bottom closure 306 may position device 326 so that device 326 may drive flow and/or force circulation of the coolant within cask 300. For example, installation of bottom closure 306 may position device 326 on or near a central axis of cask 300. In the alternative, device 326 may be, for example, associated with lid 308 (e.g., device 326 may be mounted on lid 308). Device 326 may be, for example, associated with a central portion of lid 308. Installation of lid 308 may position device 326 so that device 326 may drive flow and/or force circulation of the coolant within cask 300. For example, installation of lid 308 may position device 326 on or near a central axis of cask 300.

Device 326 may be powered by one or more devices 318. For example, all power generated by one or more devices 318 may power device 326.

Cask 300 may include more than one device 326. A first device 326 may be, for example, associated with bottom closure 306. A second device 326 may be, for example, associated with lid 308. First device 326 may be, for example, associated with a central portion of bottom closure 306 and/or second device 326 may be, for example, associated with a central portion of lid 308. Installation of bottom closure 306 and lid 308 may position first and second devices 326 so that first and second devices 326 may drive flow and/or force circulation of the coolant within cask 300.

First and second devices 326 may, for example, effectively work in series to drive flow and/or force circulation of the coolant within cask 300. In addition or in the alternative, first and second devices 326 may, for example, effectively work in parallel to drive flow and/or force circulation of the coolant within cask 300. First and second devices 326 may, for example, be configured to work by themselves or together depending on the status of bottom closure 306 and/or lid 308.

First and second devices 326 may be powered by one or more devices 318 in a suitable manner. For example, a first percentage (e.g., 60%) of the power generated by one or more devices 318 may power first device 326, while a second percentage (e.g., 40%) of the power generated by one or more devices 318 may power second device 326.

Cask 300 may include multiple devices 326. Multiple devices 326 may be, for example, associated with bottom closure 306. Installation of bottom closure 306 may position multiple devices 326 so that multiple devices 326 may drive flow and/or force circulation of the coolant within cask 300. Multiple devices 326 may be associated, for example, with storage location(s) of fuel assemblies 116 (and/or one or more other radioactive components) within cask 300 or with gaps in the storage location(s) of fuel assemblies 116 (and/or one or more other radioactive components) within cask 300. In the alternative, multiple devices 326 may be, for example, associated with lid 308. Installation of lid 308 may position multiple devices 326 so that multiple devices 326 may drive flow and/or force circulation of the coolant within cask 300. Multiple devices 326 may be associated, for example, with storage location(s) of fuel assemblies 116 (and/or one or more other radioactive components) within cask 300 or with gaps in the storage location(s) of fuel assemblies 116 (and/or one or more other radioactive components) within cask 300.

Cask 300 may include multiple devices 326 associated with bottom closure 306 and lid 308. Installation of bottom closure 306 and lid 308 may position multiple devices 326 so that multiple devices 326 may drive flow and/or force circulation of the coolant within cask 300. For example, installation of bottom closure 306 and lid 308 may position multiple devices 326 on or near a central axis of cask 300. In addition or in the alternative, multiple devices 326 may be associated, for example, with storage location(s) of fuel assemblies 116 (and/or one or more other radioactive components) within cask 300 or with gaps in the storage location (s) of fuel assemblies 116 (and/or one or more other radioactive components) within cask 300.

Multiple devices 326 may, for example, effectively work in parallel to drive flow and/or force circulation of the coolant within cask 300. In addition or in the alternative, multiple devices 326 may, for example, effectively work in series to drive flow and/or force circulation of the coolant within cask 300. Multiple devices 326 may, for example, be configured to work by themselves or together depending on the status of bottom closure 306 and/or lid 308.

Multiple devices 326 may be powered by one or more devices 318 in a suitable manner, as known to a PHOSITA. For example, a first percentage (e.g., 30%) of the power generated by one or more devices 318 may power multiple devices 326 associated with bottom closure 306, while a second percentage (e.g., 70%) of the power generated by one or more devices 318 may power multiple devices 326 associated with lid 308.

In some example embodiments, optional basket assembly 314 may include dividers or similar structures (not shown) to assist in the organization and control of fuel assemblies 316 (and/or one or more other radioactive components). The dividers or similar structures may assist devices 326 in defining the flowpath(s). In conjunction with multiple devices 326, for example, dividers or similar structures may define multiple flowpaths associated with storage location(s) of fuel assemblies 116 (and/or one or more other radioactive components) within cask 300 or with gaps in the storage location(s) of fuel assemblies 116 (and/or one or more other radioactive components) within cask 300. For example, in conjunction with multiple devices 326, dividers or similar structures may define individual flowpaths associated with each storage location of fuel assemblies 116 (and/or one or more other radioactive components) within cask 300 or with each gap in the storage location(s) of fuel assemblies 116 (and/or one or more other radioactive components) within cask 300.

Figure 4:
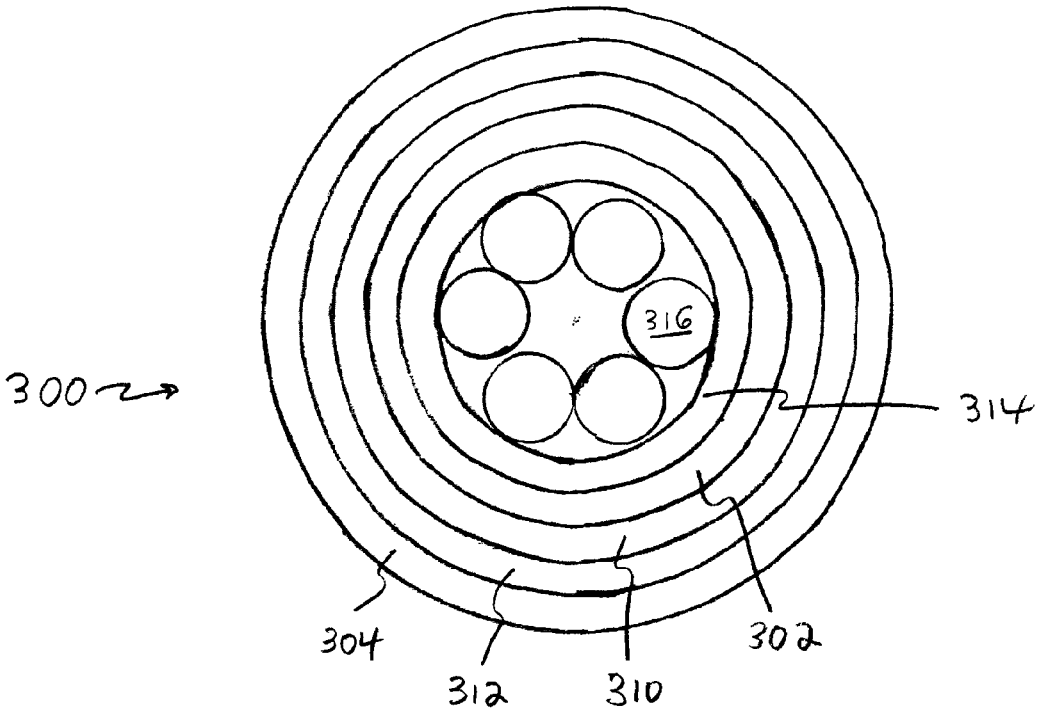
FIG. 4 is a top view of the cask of FIG. 3.

FIG. 4 is a top view of cask 300 of FIG. 3. As shown in FIGS. 3 and 4, cask 300 may be cylindrical in shape. However, in some example embodiments, cask 300 may assume other shapes, as well.

As shown in FIG. 4, cask 300 may include inner shell 302, outer shell 304, gamma radiation shielding 310, and/or neutron radiation shielding 312. Some example embodiments include alternative arrangements of inner shell 302, outer shell 304, gamma radiation shielding 310, and neutron radiation shielding 312.

As shown in FIG. 4, cask 300 may include optional basket assembly 314 for supporting, for example, one or more fuel assemblies 316 (and/or one or more other radioactive components). As shown in FIGS. 3 and 4, basket assembly 314 may be cylindrical in shape. However, in some example embodiments, basket assembly 314 may assume other shapes, as well.

In some example embodiments, basket assembly 314 may include dividers or similar structures (not shown) to assist in the organization and control of fuel assemblies 316 (and/or one or more other radioactive components) to help satisfy nuclear criticality prevention requirements. In addition or in the alternative, basket assembly 314 may provide neutron absorption to help satisfy nuclear criticality prevention requirements. Basket assembly 314 may transfer heat directly and/or indirectly to inner shell 302.

As shown in FIG. 4, basket assembly 314 may support six fuel assemblies 316 (and/or one or more other radioactive components). In the alternative, optional basket assembly 314 may support more than or fewer than six fuel assemblies 316 (and/or one or more other radioactive components).

As shown in FIGS. 3 and 4, fuel assemblies 316 may be cylindrical in shape. However, in some example embodiments, fuel assemblies 316 may assume other shapes, as well. In a top view, for example, the cross-section of fuel assemblies 316 may be rectangular or square.

In some example embodiments, the environment internal to cask 300 may be controlled when fuel assemblies 316 and/or one or more other radioactive components (not shown) are in cask 300 (e.g., within inner shell 302). For example, the volume within inner shell 302, not occupied by basket assembly 314, fuel assemblies 316, and/or one or more other radioactive components may be drained of coolant (e.g., water, liquid sodium), vacuum dried, and backfilled with a gas. Due to improved heat transfer capabilities, cask 300 may use a coolant that is less expensive than helium gas, such as nitrogen gas.

In some example embodiments, fuel assemblies 316 generate significant heat due to radioactive decay of the SNF. Engineering and safety considerations require that heat to be dissipated. The heat dissipation may be passive in nature, with heat generally flowing from fuel assemblies 316 outward toward outer shell 304, bottom closure 306, and/or lid 308. For example, the heat dissipation may be via one or more of heat conduction through solid materials, driven flow and/or forced circulation of the coolant, and thermal radiation.

Heat transfer via heat conduction may be improved, for example, by providing multiple heat flow paths from fuel assemblies 316, through basket assembly 314, to inner shell 302 and/or by providing radial heat fins (not shown) between inner shell 302 and outer shell 304. Heat transfer via driven flow and/or forced circulation of the coolant may be improved, for example, by selection of an inert gas with good heat transfer characteristics. Heat transfer via thermal radiation may be improved, for example, by increasing the temperature difference between outer shell 304, bottom closure 306, and/or lid 308 and the environment external to cask 300.

Due to improved capabilities, such as improved heat transfer capabilities, cask 300 may allow the storage and/or transportation of SNF at an earlier point in time than related art cask 100. In addition or in the alternative, a single cask 300 may accept a higher load and/or density of SNF, allowing the storage and/or transportation of SNF more efficiently than related art cask 100. These improved capabilities may result in direct cost savings due, for example, to more rapid refueling/return of reactor to power operation and/or reduction in the number of casks required to store and/or transport a given amount of SNF. These improved capabilities also may result in indirect cost savings due, for example, to reduced radiation exposure to personnel and/or reduced operating time of the associated equipment.

Cask 300 may be used in a manner similar to bare-fuel casks. In some example embodiments, bare-fuel cask 300 may be used for transportation and/or of SNF within a nuclear plant. In some example embodiments, lid 308 of bare-fuel cask 300 may include a mechanism(s) (not shown) for withdrawing SNF from the core of the nuclear reactor. Bare-fuel cask 300 may be suspended above the core, and the mechanism(s) in lid 308 may be used to withdrawing SNF from the core up into bare-fuel cask 300. When bare-fuel cask 300 is loaded, bottom closure 306 may be used to seal bare-fuel cask 300. Bottom closure 306 may include device 326. When bare-fuel cask 300 is sealed, bare-fuel cask 300 may be drained and backfilled with coolant. Device 326 may drive flow and/or force circulation of the coolant to cool the SNF. The SNF may be stored in the bare-fuel cask 300 and/or transported in the bare-fuel cask 300.

In addition or in the alternative, when bare-fuel cask 300 is loaded, bare-fuel cask 300 may be at least partially filled with coolant without sealing bare-fuel cask 300. Device 326 may drive flow and/or force circulation of the coolant to cool the SNF. The SNF may be transported in the bare-fuel cask 300. The transportation may include, for example, moving bare-fuel cask 300 loaded with SNF from above the core to another position within the nuclear plant. The another position may include, for example, a temporary storage location for bare-fuel cask 300 or a storage location for SNF, such as an SNF storage rack within the nuclear plant (e.g., a fuel service center inside a refueling or containment building).

If bare-fuel cask 300 is suspended, for example, above an SNF storage rack, the mechanism(s) in lid 308 may be used to lower the SNF into the storage rack and/or to withdraw the SNF from the storage rack. In some example embodiments, bare-fuel cask 300 may be used during defueling the reactor core, refueling the reactor core, and/or rearranging fuel assemblies within the reactor core.

In some example embodiments, when bare-fuel cask 300 is sealed, bare-fuel cask 300 may be protected by a suitable storage or transportation overpack. Such overpacks may include concrete and/or steel. Such overpacks may protect bare-fuel cask 300 from external natural phenomena and/or made-made events. Such overpacks may provide radiation shielding and/or heat dissipation.

These and other uses of bare-fuel cask 300 may apply to fuel assemblies 316 and/or other radioactive components.

In the alternative, cask 300 may be used in a manner similar to the canister in canister-based systems. In some example embodiments, canister-based cask 300 with bottom closure 306 (e.g., welded) may be positioned near the core of the nuclear reactor. A crane or similar device may withdraw the SNF from the core, move the SNF to canister-based cask 300, and lower the SNF into canister-based cask 300. When canister-based cask 300 is loaded, lid 308 may be used to seal canister-based cask 300 (e.g., bolted or welded).

In some example embodiments, bottom closure 306 may include device 326. When canister-based cask 300 is sealed, canister-based cask 300 may be drained and backfilled with coolant. Device 326 may drive flow and/or force circulation of the coolant to cool the SNF. The SNF may be stored in the canister-based cask 300 and/or transported in the canister-based cask 300.

In some example embodiments, when canister-based cask 300 is sealed, canister-based cask 300 may be protected by a suitable storage or transportation overpack. As known to a PHOSITA, such overpacks typically include concrete and/or steel. As known to a PHOSITA, such overpacks typically protect canister-based cask 300 from external natural phenomena and/or made-made events. As known to a PHOSITA, such overpacks typically provide radiation shielding and/or heat dissipation.

The ability of cask 300 to be used in a manner similar to bare-fuel casks, to be used in a manner similar to the canister in canister-based systems, and/or to be used to transport SNF within the nuclear plant provides significant advantages in terms of cost, design, and flexibility over related art cask 100.

Figure 5:
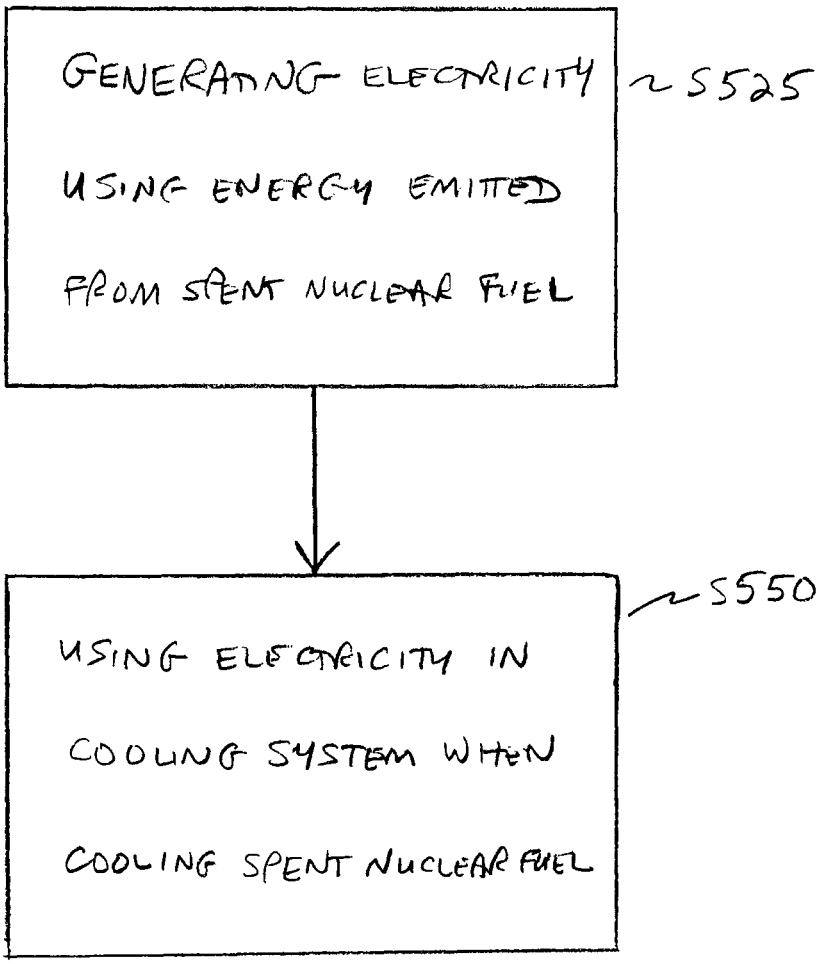
FIG. 5 is a flowchart of a method for cooling SNF according to some example embodiments.

FIG. 5 is a flowchart of a method for cooling SNF according to some example embodiments.

As shown in S525 of FIG. 5, electricity may be generated using energy emitted from the SNF, for example, from radioactive decay of the SNF (e.g., alpha decay, beta decay, and/or gamma rays). The energy emitted from the SNF may include heat. Thus, the electricity may be generated, for example, using this heat emitted from the SNF.

The electricity may be generated based on a thermoelectric effect. The thermoelectric effect may be the Seebeck effect. Thus, the electricity may be generated, for example, based on the Seebeck effect.

The electricity may be generated using an RTG. The RTG may include one or more arrays of thermocouples and/or thermionic devices. Thus, the electricity may be generated, for example, using the one or more arrays of thermocouples and/or thermionic devices.

As shown in S550 of FIG. 5, the generated electricity may be used in a cooling system for the SNF when cooling the SNF. The generated electricity may be used to provide power to the cooling system.

The electricity may be used, for example, to power a device configured to drive flow of coolant that cools the SNF. The electricity may be used to power a device configured to force circulation of the coolant that cools the SNF. The driven flow and/or forced circulation may provide improved heat transfer from the SNF over natural convection, natural circulation, or other non-driven flow and/or non-forced circulation systems.

The method also may include defining one or more flowpaths for the coolant. In addition, the method may include causing the coolant to follow the one or more flowpaths when cooling the SNF.

Initially, the SNF may be placed in wet storage. The water or other coolant may provide both radiation shielding and cooling. In wet storage, the ultimate heat sink for energy emitted from the SNF may be the environment (e.g., the atmosphere), albeit indirectly via the wet storage pool (sometimes supplemented by one or more cooling systems associated with the wet storage pool).

After the SNF is placed in dry storage, the ultimate heat sink for energy emitted from the SNF also may be the environment (e.g., the atmosphere), albeit more directly than when in wet storage.

Suitable arrangements for the ultimate heat sink are known to a PHOSITA.

For bare-fuel casks, cask 300 may provide radiation shielding. Cask 300 also may provide cooling, for example, via heat conduction through solid materials, driven flow and/or forced circulation of coolant, and/or thermal radiation.

In addition, if an overpack is used, the overpack also may provide radiation shielding. Further, the overpack may provide cooling, for example, via heat conduction through solid materials, natural convection of air between cask 300 and the overpack, and/or thermal radiation.

For canister-based systems, cask 300—used in a manner similar to the canister in canister-based systems—may provide cooling, for example, via heat conduction through solid materials, driven flow and/or forced circulation of coolant, and/or thermal radiation.

In addition, if an overpack is used, the overpack also may provide radiation shielding. Further, the overpack may provide cooling, for example, via heat conduction through solid materials, natural convection of air between cask 300 and the overpack, and/or thermal radiation.

While example embodiments have been particularly shown and described, it will be understood by those of ordinary skill in the art that various changes in form and details may be made therein without departing from the spirit and scope of the present invention as defined by the following claims.

What is claimed is:

1. A cask for dry storage, transport, or dry storage and transport of fuel assemblies of spent nuclear fuel, the cask comprising:

a container configured to hold the fuel assemblies of the spent nuclear fuel and configured for transport of the fuel assemblies, the container being a dry storage container; and a cooling system for the fuel assemblies of spent nuclear fuel in dry storage, the cooling system including:

a first device configured to generate electricity using energy emitted from the fuel assemblies of the spent nuclear fuel in dry storage, a second device configured to use the generated electricity to cool the fuel assemblies of the spent nuclear fuel in dry storage, and coolant;

wherein the second device comprises at least one compressor, fan, or pump, wherein the second device is configured to cause the coolant to flow relative to the fuel assemblies of the spent nuclear fuel in dry storage, to cause the coolant to acquire the energy emitted from the fuel assemblies of the spent nuclear fuel in dry storage, to cause the coolant to flow relative to the first device, and to cause the coolant to transfer at least some of the acquired energy to the first device, and wherein the second device is internal to the container and the coolant is circulated only within the container.

2. The cask of claim 1, wherein the first device is configured to generate electricity using heat energy emitted from the fuel assemblies of the spent nuclear fuel in dry storage.

3. The cask of claim 1, wherein the first device is configured to generate electricity based on a thermoelectric effect.

4. The cask of claim 1, wherein the first device is configured to generate electricity based on a Seebeck effect.

5. The cask of claim 1, wherein the coolant comprises one or more of helium (He), neon (Ne), argon (Ar), krypton (Kr), xenon (Xe), radon (Rn), and nitrogen (N).

6. The cask of claim 1, wherein the coolant comprises one or more of helium (He) gas, neon (Ne) gas, argon (Ar) gas, krypton (Kr) gas, xenon (Xe) gas, radon (Rn) gas, and nitrogen ($N_2$) gas.

7. The cask of claim 1, wherein the coolant comprises air.

8. The cask of claim 1, wherein the coolant comprises water.

9. The cask of claim 1, wherein the coolant comprises liquid sodium.

10. The cask of claim 1, wherein all of the cooling system is internal to the container.

11. The cask of claim 1, wherein one or more portions of the cooling system are external to the container.

12. The cask of claim 1, further comprising:

a flowpath for the coolant within the container;

wherein the cooling system is configured to cause the coolant to follow the flowpath when cooling the fuel assemblies of the spent nuclear fuel in dry storage.

13. The cask of claim 1, wherein the first device, the second device, or the first and second devices directly contact the coolant.

14. The cask of claim 1, the container further comprising:

an outer shell;

an inner shell within the outer shell;

at least one radiation shield between the inner shell and the outer shell;

a bottom closure along a bottom of the inner shell, the outer shell, and the at least one radiation shield; and a lid along a top of the inner shell, the outer shell, and the at least one radiation shield.

15. The cask of claim 1, wherein the second device is arranged substantially at a central axis of the container.

16. A cask for dry storage, transport, or dry storage and transport of fuel assemblies of spent nuclear fuel, the cask comprising:

a container configured to hold the fuel assemblies of the spent nuclear fuel and configured for transport of the fuel assemblies, the container being a dry storage container; and a cooling system for fuel assemblies of spent nuclear fuel in dry storage, the cooling system including, a first device configured to generate electricity using energy emitted from the fuel assemblies of the spent nuclear fuel in dry storage, a second device configured to use the electricity to cool the fuel assemblies of the spent nuclear fuel in dry storage, and coolant;

wherein the first device comprises a thermionic device or two or more thermionic devices connected to each other in series to form a closed loop, wherein the second device comprises at least one compressor, fan, or pump, wherein the second device is configured to cause the coolant to flow relative to the fuel assemblies of the spent nuclear fuel in dry storage, to cause the coolant to acquire the energy emitted from the fuel assemblies of the spent nuclear fuel in dry storage, to cause the coolant to flow relative to the first device, and to cause the coolant to transfer at least some of the acquired energy to the first device, and wherein the second device is internal to the container and the coolant is circulated only within the container.

17. The cask of claim 16, wherein the first device, the second device, or the first and second devices directly contact the coolant.

18. A cask for dry storage, transport, or dry storage and transport of fuel assemblies of spent nuclear fuel, the cask comprising:

a container configured to hold the fuel assemblies of the spent nuclear fuel and configured for transport of the fuel assemblies, the container being a dry storage container; and a cooling system for fuel assemblies of spent nuclear fuel in dry storage, the cooling system including, a first device configured to generate electricity using energy emitted from the fuel assemblies of the spent nuclear fuel in dry storage, a second device configured to use the electricity to cool the fuel assemblies of the spent nuclear fuel in dry storage, and coolant, wherein the first device comprises a thermocouple, two or more thermocouples connected to each other in series to form a closed loop, a thermionic device, or two or more thermionic devices connected to each other in series to form a closed loop, wherein the second device comprises at least one compressor, fan, or pump, wherein the second device is configured to cause the coolant to flow relative to the fuel assemblies of the spent nuclear fuel in dry storage, to cause the coolant to acquire the energy emitted from the fuel assemblies of the spent nuclear fuel in dry storage, to cause the coolant to flow relative to the first device, and to cause the coolant to transfer at least some of the acquired energy to the first device, and wherein the second device is internal to the container and the coolant is circulated only within the container.

19. The cask of claim 18, wherein the first device directly contacts the coolant.

20. The cask of claim 18, wherein the second device directly contacts the coolant.

21. The cask of claim 18, wherein the first device or the second device directly contacts the coolant.

22. The cask of claim 18, wherein the first device and the second device directly contact the coolant.

* * * * *